US009353654B2

(12) United States Patent
Yang et al.

(10) Patent No.: US 9,353,654 B2
(45) Date of Patent: May 31, 2016

(54) FIXED CHAIN TYPE ENGINE BRAKING DEVICE

(75) Inventors: Zhou Yang, Oak Ridge, NC (US); Enjiu Ke, Shanghai (CN); Yong Xi, Shanghai (CN)

(73) Assignee: Shanghai Universoon Autoparts Co., Ltd., Shanghai (CN)

( * ) Notice: Subject to any disclaimer, the term of this patent is extended or adjusted under 35 U.S.C. 154(b) by 385 days.

(21) Appl. No.: 13/698,618

(22) PCT Filed: May 3, 2011

(86) PCT No.: PCT/CN2011/000768

§ 371 (c)(1),
(2), (4) Date: Nov. 16, 2012

(87) PCT Pub. No.: WO2011/147190

PCT Pub. Date: Dec. 1, 2011

(65) Prior Publication Data

US 2013/0061829 A1 Mar. 14, 2013

(30) Foreign Application Priority Data

May 27, 2010 (CN) ..... 2010 1 0186306

(51) Int. Cl.
*F01L 13/06* (2006.01)
*F01L 13/08* (2006.01)
(Continued)

(52) U.S. Cl.
CPC . *F01L 13/06* (2013.01); *F01L 1/08* (2013.01); *F01L 1/181* (2013.01); *F01L 1/26* (2013.01); *F01L 13/065* (2013.01); *F01L 13/08* (2013.01);
(Continued)

(58) Field of Classification Search
CPC ..... F01L 13/065; F01L 13/06; F01L 13/08; F02D 13/04; F02D 41/12; F02D 9/06
USPC ..... 123/320, 321, 322, 323, 90.15, 90.12, 123/90.13, 90.45, 90.46, 90.52
See application file for complete search history.

(56) References Cited

U.S. PATENT DOCUMENTS 3,220,392 A 11/1965 Cummins
4,697,558 A 10/1987 Meneely
(Continued)

FOREIGN PATENT DOCUMENTS

CN 201228591 4/2009
CN 101672206 A 3/2010
(Continued)

OTHER PUBLICATIONS

International Search Report, PCT app. No. CN2011-000768, mailed Aug. 18, 2011, pp. 5.
(Continued)

*Primary Examiner* — Mahmoud Gimie
(74) *Attorney, Agent, or Firm* — RuyakCherian LLP

(57) ABSTRACT

A fixed chain engine braking device includes a brake box, a driving mechanism and a braking mechanism. One upright blind hole and one horizontal blind hole are placed in the brake box, and the upright blind hole intersects the horizontal blind hole orthogonally. The driving mechanism includes a rolling ball and/or a driving piston placed in the horizontal blind hole, the braking mechanism includes a braking plunger placed in the upright blind hole. A fluid passage is placed in the brake box, and the fluid passage is communicated with the entry of the horizontal blind hole.

11 Claims, 7 Drawing Sheets

(51) Int. Cl.

| | |
|---|---|
| ***F02D 41/12*** | (2006.01) |
| ***F02D 13/04*** | (2006.01) |
| ***F02D 9/06*** | (2006.01) |
| ***F01L 1/08*** | (2006.01) |
| ***F01L 1/18*** | (2006.01) |
| ***F01L 1/26*** | (2006.01) |
| *F01L 1/053* | (2006.01) |

(52) U.S. Cl.
CPC *F02D 9/06* (2013.01); *F02D 13/04* (2013.01); *F02D 41/12* (2013.01); *F01L 2001/0537* (2013.01); *F01L 2105/00* (2013.01)

(56) References Cited

U.S. PATENT DOCUMENTS

| | | | | |
|---|---|---|---|---|
| 4,711,210 | A | | 12/1987 | Reichenbach |
| 5,146,890 | A | | 9/1992 | Gobert et al. |
| 5,365,916 | A | | 11/1994 | Freiburg et al. |
| 5,460,131 | A | * | 10/1995 | Usko ..... 123/321 |
| 5,462,025 | A | * | 10/1995 | Israel et al. ..... 123/321 |
| 5,511,460 | A | * | 4/1996 | Custer ..... 91/401 |
| 5,611,308 | A | | 3/1997 | Hackett |
| 6,189,504 | B1 | | 2/2001 | Israel et al. |
| 6,244,257 | B1 | * | 6/2001 | Hu ..... 123/568.14 |
| 6,415,752 | B1 | | 7/2002 | Janak |
| 6,708,656 | B1 | * | 3/2004 | Chang ..... 123/90.12 |
| 7,789,065 | B2 | | 9/2010 | Yang |
| 7,909,017 | B2 | | 3/2011 | Yang |
| 8,065,987 | B2 | | 11/2011 | Yang |
| 2003/0172889 | A1 | | 9/2003 | Djordjevic |
| 2005/0087170 | A1 | * | 4/2005 | Rammer et al. ..... 123/321 |

FOREIGN PATENT DOCUMENTS

| | | | |
|---|---|---|---|
| CN | 201513212 | | 6/2010 |
| CN | 201751554 | | 2/2011 |
| DE | 102008059192 | A1 | 6/2009 |
| EP | 1857642 | A1 | 11/2007 |
| RU | 2145384 | C1 | 2/2000 |
| RU | 2301370 | C2 | 6/2007 |
| WO | 97/06355 | A1 | 2/1997 |

OTHER PUBLICATIONS

European Search Report dated Nov. 18, 2013 for Application No. 11785962.9-1606/2578820 PCT/CN2011000768.

* cited by examiner

FIXED CHAIN TYPE ENGINE BRAKING DEVICE

FIELD OF THE INVENTION

The present application relates to the mechanical field, specifically to an engine brake device, and particularly to a mechanical linkage engine brake device.

BACKGROUND OF THE INVENTION

It is well known in the prior art to use an internal combustion engine as a brake means by converting the engine temporarily to an air compressor. The conversion starts by cutting off the provision of the fuel, opening the exhaust valve(s) at or near the end of the compression stroke of the engine piston, and allowing the compressed gases (air during braking) to be released. The energy absorbed by the compressed gas during the compression stroke of the engine can not be transmitted to the engine piston through the subsequent expansion stroke, but is dissipated by the exhaust and cooling systems of the engine, resulting in an effective engine braking. Thereby the vehicle is slowed down.

An example of the engine brake device is disclosed in U.S. Pat. No. 3,220,392 by Cummins, and an engine brake system based on the patent has achieved a great commercial success. However, this kind of engine brake system is a bolt-on accessory mounted at the top of the engine. In order to mount this kind of brake system, a spacer is additionally provided between the cylinder head and the valve cover, which adds unnecessary height, weight and costs to the engine. The above problems occur due to the fact that the engine brake system is employed as an accessory to, rather than an integrated part of, the engine.

The prior engine brake transmits the mechanical input to the exhaust valve(s) to be opened through a hydraulic circuit. A master piston reciprocating in a master piston bore is located in the hydraulic circuit. The reciprocating motion is provided by the mechanical input of the engine, such as the rocking of the injector rocker arm. The motion of the master piston is transmitted, through hydraulic fluid, to a slave piston located in the hydraulic circuit, causing the slave piston to reciprocate in a slave piston bore. The slave piston acts, directly or indirectly, on the exhaust valve(s), generating the valve event for the engine braking operation.

Therefore, the conventional hydraulic-driven engine brake has another drawback due to the compliance or deformable of the hydraulic system, which is relevant to the flexibility of the fluid. High flexibility of the fluid greatly reduces the brake valve lift. The reduction of the brake valve lift leads to the increase of the braking load, which in turn causes a higher flexibility, thereby forming a vicious circle. In addition, the brake valve lift reduction caused by the hydraulic deformation increases with the increase of the engine speed, which is against the engine braking performance requirement that higher engine speed needs higher brake valve lift. In order to reduce the hydraulic flexibility, a large diameter hydraulic piston is needed, which increases the volume and weight as well as the time of oil refill or discharge for extending or retracting such a large diameter piston. That is to say, a large diameter hydraulic piston will increase the momentum of inertia and response time of the engine brake system.

SUMMARY OF THE INVENTION

The purpose of the present application is to provide a mechanical linkage engine brake device to solve the technical problems of the prior hydraulic-driven engine brake system, for example, the increased height and weight of the engine, the increased system complexity and inertia of the engine brake system, and the slow response of the engine brake system.

The mechanical linkage engine brake device according to the present application includes a brake housing, an actuation mechanism and a brake mechanism. The brake housing is provided therein with an upright blind bore and a horizontal blind bore perpendicularly intersecting the upright blind bore. The actuation mechanism includes a ball or an actuation piston, or a ball-piston combination. The brake mechanism includes a brake plunger. The ball, or the actuation piston, or the ball-piston combination is disposed in the horizontal blind bore. The brake plunger is disposed in the upright blind bore. The brake housing is provided therein with a fluid passage in communication with an entrance of the horizontal blind bore. An outer diameter of the ball or the actuation piston, or an outer diameter of the ball-piston combination matches an inner diameter of the horizontal blind bore. The brake plunger has an upper limit position and a lower limit position in the upright blind bore. In the upper limit position, a top of the brake plunger stands in the horizontal blind bore; and in the lower limit position, the top of the brake plunger stands outside of the horizontal blind bore.

Further, the actuation mechanism includes a return spring, which has one end acting on the brake housing and the other end acting on the actuation piston or on the ball-piston combination.

Further, a liquid seal is formed between the actuation piston and the horizontal blind bore.

Further, the actuation mechanism further includes a ball. One side of the ball is in contact with the actuation piston, while the other side of the ball is in contact with the return spring.

Further, the actuation mechanism includes a return piston. The return piston is disposed in the horizontal blind bore and is pressed against the ball by the return spring. A liquid seal is formed between the return piston and the horizontal blind bore.

Further, the return piston has a decompression and bleeding orifice communicating with the horizontal blind bore and a space outside the brake housing.

Further, the actuation mechanism includes two return springs provided in the horizontal blind bore, and the two return springs are arranged at opposite sides of the ball.

Further, the upright blind bore is provided therein with a brake spring, the brake spring being provided between a lower end of the brake plunger and the brake housing.

Further, a position limiter is provided between the brake plunger and the upright blind bore.

Further, the position limiter includes a groove and a stop pin, wherein the groove is formed in a central portion of an outer surface of the brake plunger and is extended axially, the stop pin is fixedly provided in a middle portion of an inner wall of the upright blind bore. A length of the groove is larger than a diameter of the stop pin, and the stop pin is located in the groove.

Further, an upper end of the brake plunger is provided with a brake transition surface and a brake bearing surface. Each of the brake transition surface and the brake bearing surface is a flat surface including a stepped surface and an inclined surface, or a conical surface, or an arc surface, or a cylindrical surface, or a spherical surface, or a combination of two or more of the above-mentioned surfaces.

Further, one end of the actuation piston is provided with a brake actuation surface. The brake actuation surface is a flat surface including an inclined surface, or a conical surface, or an arc surface, or a cylindrical surface, or a spherical surface, or a combination of two or more of the above-mentioned surfaces.

Further, the brake housing includes at least one of the following:

a dedicated bolt-on brake housing, a dedicated brake rocker arm, an engine exhaust rocker arm, and an engine valve bridge.

The operation principle of the present application is: when it needs to convert the state of the engine from the normal operation to the engine braking operation, the engine brake controller is turned on to supply oil to the fluid passage in the brake housing through a brake fluid passage. The actuation piston or the ball is pushed, overcoming the actions of the returning spring and the braking spring, to the right along the horizontal blind bore under the pressure of the oil, such that the brake plunger is moved downwards in the upright blind bore. Thereby the engine brake is switched from the inoperative position to the operative position, and the engine is converted from the normal operation to the engine braking operation. When it does not need the engine braking operation, the engine brake controller is turned off to drain the oil, such that no oil pressure is applied to the actuation piston or the ball, thereby the actuation piston or the ball is moved to the left under the action of the return spring until the actuation piston is stopped against the left end surface of the horizontal blind bore. The brake plunger is moved upwards in the upright blind bore under the force of the brake spring. The engine brake is switched from the operative position to the inoperative position, and the engine is free of the influence of the engine brake and can operate normally.

The present application has many advantageous technical effects over the prior art. The present application does not employ a hydraulic brake control valve, which simplifies the design, reduces the cost and the braking response time. The present application does not employ liquid to carry the braking load, and therefore can avoid problems, such as leakage, deformation or load fluctuation caused by high oil pressure and temperature. The brake valve lift can be designed with a smaller value because it is not affected by oil temperature, oil pressure and air content in oil, which allows a smaller clearance between the engine piston and valve. Also the mechanical linkage engine brake device of the present application can be integrated into the engine to reduce the height, the size and the weight of the engine brake.

DETAILED DESCRIPTION

First Embodiment

Figure 1:
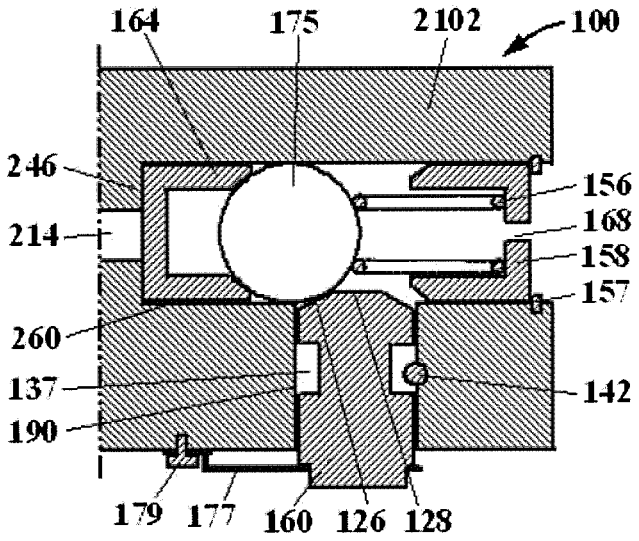
FIG. 1 is a schematic diagram of a first embodiment of the present application at the "off" position.
Figure 2:
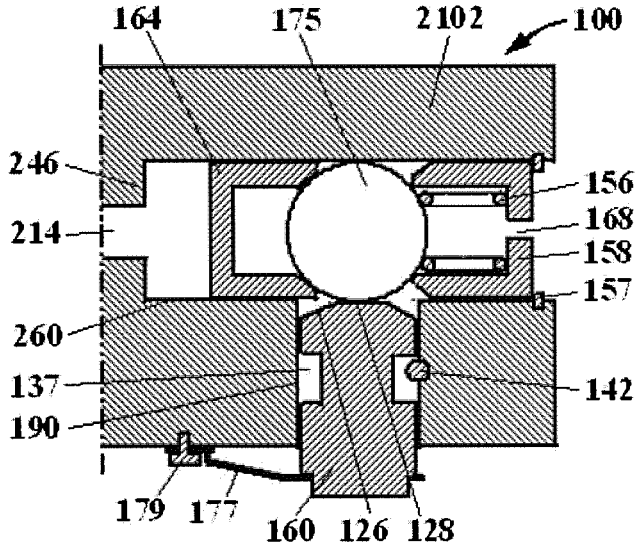
FIG. 2 is a schematic diagram of the first embodiment of the present application at the "on" position.

As shown in FIG. 1 and FIG. 2, the mechanical linkage engine brake device 100 according to the present application includes a brake housing 2102, an actuation mechanism and a brake mechanism. The brake housing 2102 is provided therein with an upright blind bore 190 and a horizontal blind bore 260 that intersect each other. The actuation mechanism includes an actuation piston 164 and a ball 175. The actuation piston 164 and the horizontal blind bore 260 form a liquid seal. One end of the actuation piston is in contact with the ball to form a linkage. The brake mechanism includes a brake plunger 160. As shown in FIG. 1, the actuation piston 164 and the ball 175 are disposed in the horizontal blind bore 260 in the brake housing 2102, and are pushed to the left by a return spring 156 to thereby abut against the end surface 246 of the piston bore 260 at normal state. One end of the return spring 156 is on the ball 175 of the actuation mechanism while the other end thereof is on the spring seat 158. The spring seat 158 is positioned by a retaining ring 157 fixedly connected on the brake housing 2102. The spring seat 158 has a venting hole 168. The brake plunger 160 is disposed in the upright blind bore 190 in the brake housing 2102. The upper end of the brake plunger has a brake transition surface 126 and a brake bearing surface 128. The brake transition surface 126 is a conical surface but may also be a flat surface (including a stepped surface and an inclined surface), or an arc surface, or a cylindrical surface, or a spherical surface, or a combination of two or more of the above-mentioned surfaces. Similarly, the brake bearing surface 128 may be a flat surface (including a stepped plane and an inclined plane), or a conical surface, or an arc surface, or a cylindrical surface, or a spherical surface, or a combination of two or more of the above-mentioned surfaces. One end of a brake spring 177 is provided at the lower end of the brake plunger 160, while the other end thereof is fixedly connected on the brake housing 2102 by a screw 179. As shown in FIG. 1, under the action of the spring 177, the brake transition surface 126 of the brake plunger 160 is stopped against the lower right side of the ball 175.

The brake mechanism further includes a position limiter for the brake plunger 160, including a stop pin 142 fixedly provided in the brake housing and a groove 137 in the brake plunger 160. The position limiter may also be formed in other ways, such as by using stepped surfaces.

The work process of the present embodiment is as follows: when it needs to convert the state of the engine from the normal operation (FIG. 1) to the engine braking operation (FIG. 2), an engine brake controller (not shown) is turned on to supply oil to the actuation mechanism of the mechanical linkage engine brake device 100 through a braking fluid passage including a fluid passage 214 in the brake housing 2102. The actuation piston 164 and the ball 175 are pushed, overcoming the force of the return spring 156, to the right under the pressure of the oil. The ball 175 is pushed to press the brake transition surface 126 on the upper end of the brake plunger 160 to overcome the action of the brake spring 177, such that the brake plunger 160 is pushed downwards along the upright blind bore 190 from an inoperative position to an operative position. At the same time, the ball 175 is moved from the brake transition surface 126 to the brake bearing surface 128 at the upper end of the brake plunger 160 (FIG. 2).

When it does not need the engine braking operation, the engine brake controller is turned off to drain the oil, such that no oil pressure is applied to the actuation piston 164 and the ball 175, thereby the actuation piston 164 and the ball 175 are moved to the left under the force of the return spring 156 and are stopped against the left end surface 246 of the horizontal blind bore 260. The brake plunger 160 is pushed, under the force of the brake spring 177, upwards in the upright blind bore 190, such that the brake transition surface 126 at the upper end is stopped against the lower right side of the ball 175. Thereby the brake plunger is back to the inoperative position (FIG. 1), and the engine is free from the influence of the brake plunger and can operate normally.

Second Embodiment

Figure 3:
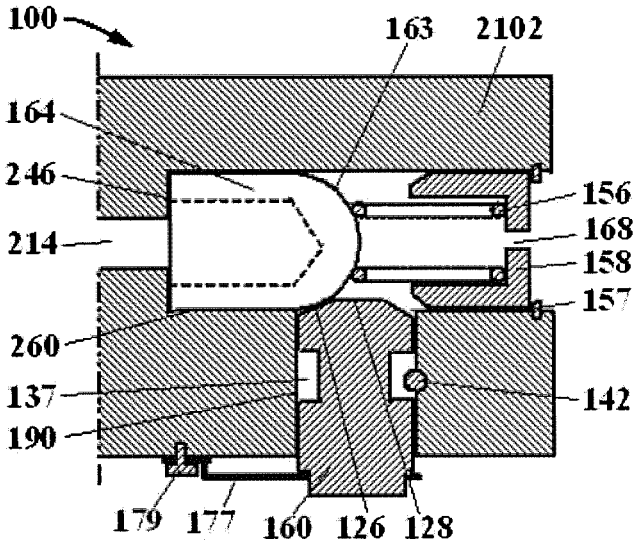
FIG. 3 is a schematic diagram of a second embodiment of the present application at the "off" position.
Figure 4:
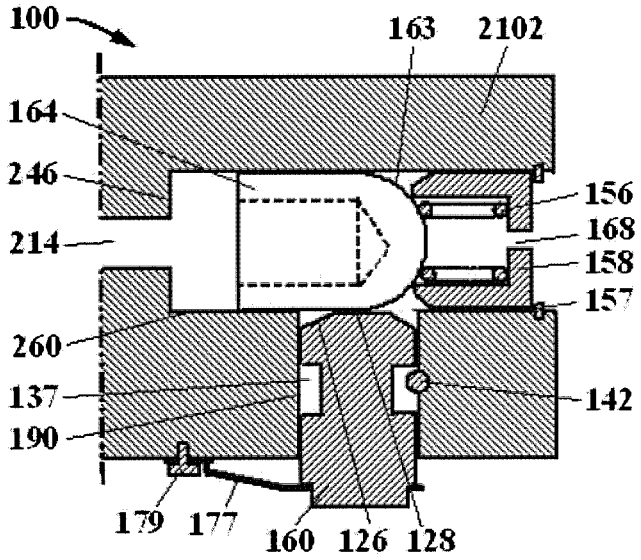
FIG. 4 is a schematic diagram of the second embodiment of the present application at the "on" position.

As shown in FIG. 3 and FIG. 4, the second embodiment is a variation of the first embodiment. The actuation piston 164 and the ball 175 in the first embodiment are combined into one body. The left part of the body is part of the actuation piston 164 that provides guide and seal, while the right part of the body is the actuation surface 163 of a spherical shape (which may also be a cone surface or other surfaces).

Third Embodiment

Figure 5:
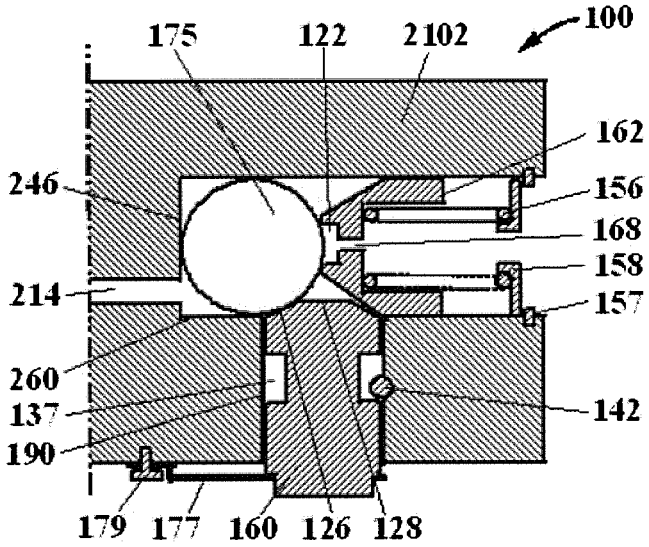
FIG. 5 is a schematic diagram of a third embodiment of the present application at the "off" position.
Figure 6:
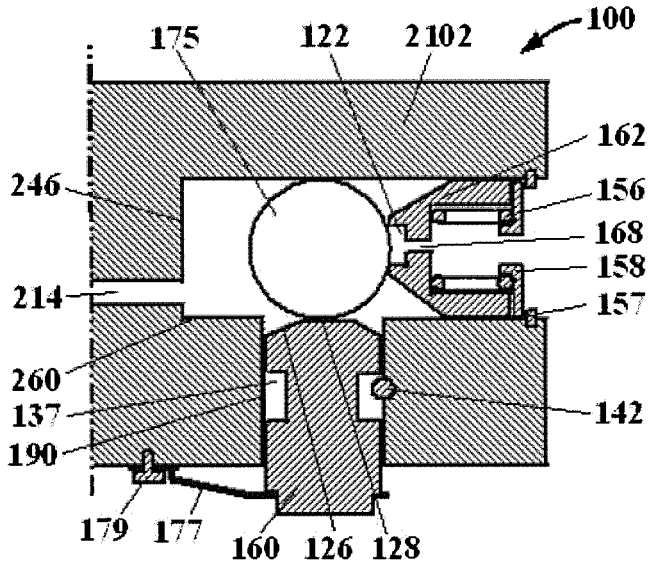
FIG. 6 is a schematic diagram of the third embodiment of the present application at the "on" position.

As shown in FIG. 5 and FIG. 6, the third embodiment is also a variation of the first embodiment. Compared with the first embodiment, the actuation piston in the first embodiment is eliminated, and a return piston 162 that forms a liquid seal with the horizontal blind bore 260 is further provided. The return piston 162 is provided with a decompression hole 122 and a bleeding orifice 168 (which may also be a combined cone-shaped decompression and bleeding orifice). The return piston 162 functions together with the return spring 156. The return spring 156 forces the return piston 162 against the ball 175 such that the decompression hole 122 is closed and to ensure that the ball 175 is always in close contact with the return piston 162.

The present embodiment operates as follows: when it need to convert the state of the engine from the normal operation (see FIG. 5) to the engine braking operation (FIG. 6), the engine brake controller (not shown) is turned on to supply oil to the actuation mechanism of the engine brake device 100 through the brake fluid passage including the fluid passage 214 in the brake housing 2102. The ball 175 is firstly pushed, overcoming the force of the return spring 156, under the action of the oil. At the same time, the oil flow passes the ball (through the gap between the ball and the bore or an axial groove not shown in the Figure), and pushes, overcoming the force of the brake spring 177, the brake plunger 160 downwards along the upright blind bore 190. The maximum downward stroke of the brake plunger 160 is determined by the position limiter (the stop pin 142 and the groove 137). The ball 175 is pressed against the return piston 162, and the two move together to the right until the return piston 162 is stopped by the spring seat 158. At this point, the ball 175 is moved onto the brake bearing surface 128 on the top of the brake plunger 160, and the brake plunger 160 is moved downwards to the operative position as shown in FIG. 6.

When it does not need the engine braking operation, the engine brake controller is turned off to drain the oil such that no oil pressure is applied to the return piston 162 and the ball 175, thereby the return piston 162 and the ball 175 are moved to the left by the return spring 156 and are stopped against the left end surface 246 of the horizontal blind bore 260. The brake plunger 160 is moved upwards in the upright blind bore 190 by the brake spring 177, such that the brake transition surface 126 at the upper end is stopped against the lower right side of the ball 175. Thereby the brake plunger is back to the inoperative position (FIG. 5) and is separated from the normal engine operation.

Fourth Embodiment

Figure 7:
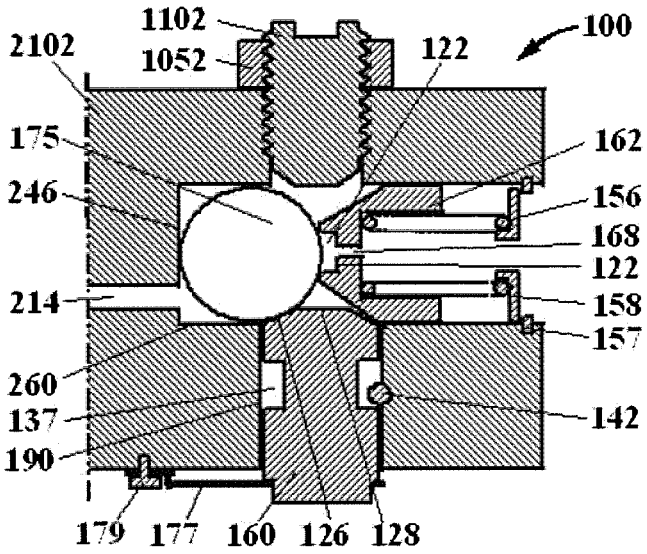
FIG. 7 is a schematic diagram of a fourth embodiment of the present application at the "off" position.
Figure 8:
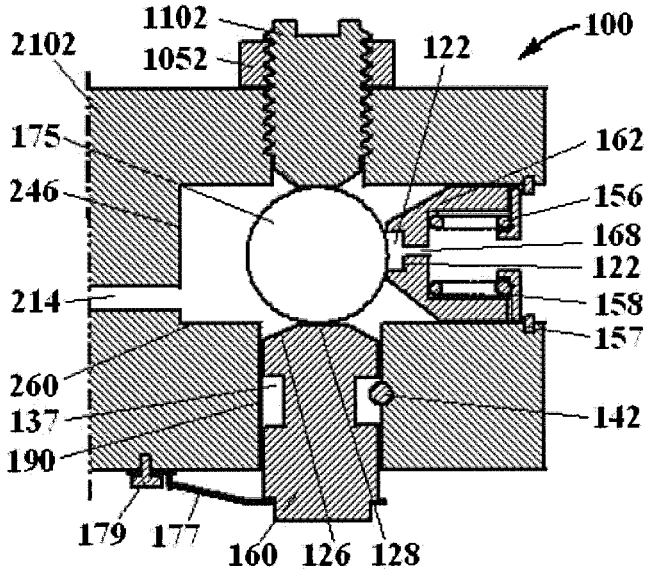
FIG. 8 is a schematic diagram of the fourth embodiment of the present application at the "on" position.
Figure 9:
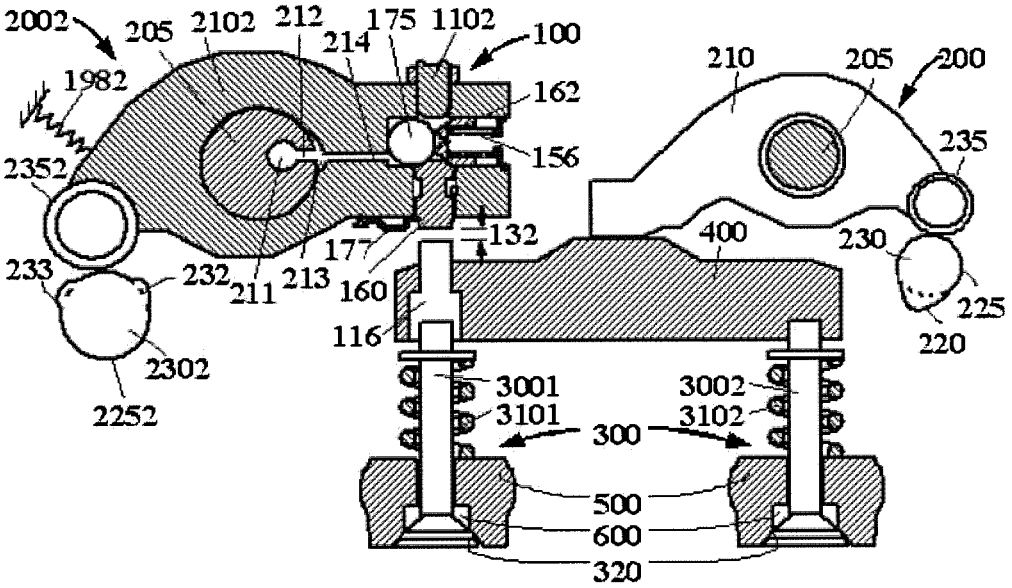
FIG. 9 is a schematic diagram of an application of the fourth embodiment of the present application.

As shown in FIG. 7, FIG. 8 and FIG. 9, the present embodiment, compared with the third embodiment, only is further provided with a brake valve lash adjusting screw 1102 that is fixedly connected on the brake housing 2102 by a lock nut 1052. The operation principle of the fourth embodiment is similar to that of the third embodiment.

FIG. 9 is a schematic diagram illustrating an application of the present embodiment. The brake housing 2102 of the engine brake device 100 is a dedicated brake rocker arm of a dedicated exhaust valve actuator 2002 for engine braking. The dedicated exhaust valve actuator 2002 further includes a brake cam 2302, a cam follower 2352 and a rocker brake spring 1982. The brake cam 2302 is merely provided, on the inner base circle 2252 thereof, with the small cam lobes 232 and 233 for engine braking.

The normal operation of the engine exhaust valves 300 is driven by an engine exhaust valve system or an engine exhaust valve actuator 200. The exhaust valve actuator 200 includes many components, including a cam 230, a cam follower 235, a rocker arm 210, a valve bridge 400, and exhaust valves 300. The exhaust valves 300 are biased, by engine valve springs 3101 and 3102, against the valve seats 320 in the engine cylinder block 500, to prevent gas flow between the engine cylinder and the exhaust manifold 600. The rocker arm 210 is rotationally installed on the rocker shaft 205, passing the motion of the cam 230 to the exhaust valves 300 for their cyclic opening and closing. The exhaust valve system may also include other components, such as a valve lash adjusting screw and an e-foot, etc., which are omitted herein for brevity. The cam 230 has a large cam lobe 220 on the inner base circle 225 thereof to produce the main valve lift profile for the normal engine operation.

When it needs to convert the state of the engine from the normal operation to the engine braking operation, the engine brake controller (not shown) is turned on to supply oil to the engine brake device 100 through the brake fluid passage that includes a fluid passage 211 and a radial hole 212 in the rocker arm shaft, a groove 213 and a fluid passage 214 in the rocker arm. The ball 175 together with the return piston 162 is pushed, overcoming the forces of the brake spring 177 on the brake plunger 160 and the return spring 156 successively, to the right under the action of the oil, such that the brake plunger 160 is moved from the retracted position (shown in FIG. 7) to the extended position (shown in FIG. 8). The stroke of the brake plunger eliminates the gap 132 between the brake plunger 160 and the brake rod 116 (shown in FIG. 9). The motion of the small cam lobes 232 and 233 of the brake cam 2302 is transmitted to the exhaust valve 3001 through the rocker arm 2102, the brake valve lash adjusting screw 1102, the ball 175, the brake plunger 160 and the brake rod 116, for engine braking.

When it does not need the engine braking operation, the engine brake controller is turned off to drain the oil, such that no oil is applied to the ball 175 and the return piston 162, thereby the ball 175 and the return piston 162 are moved to the left under the action of the return spring 156 until the ball 175 is stopped against the end surface 246 of the horizontal blind bore 260 (FIG. 7). The brake plunger 160 is moved upwards in the upright blind bore 190 to the inoperative position, forming the gap 132 with the brake rod 116 (shown in FIG. 9). Thereby the engine is free from the influence of the engine brake device 100 and can operate normally.

In addition to the dedicated brake rocker arm, the brake housing 2102 of the engine brake device 100 may be a dedicated bolt-on brake housing (box), the exhaust rocker arm of the engine, or the valve bridge of the engine.

Fifth Embodiment

Figure 10:
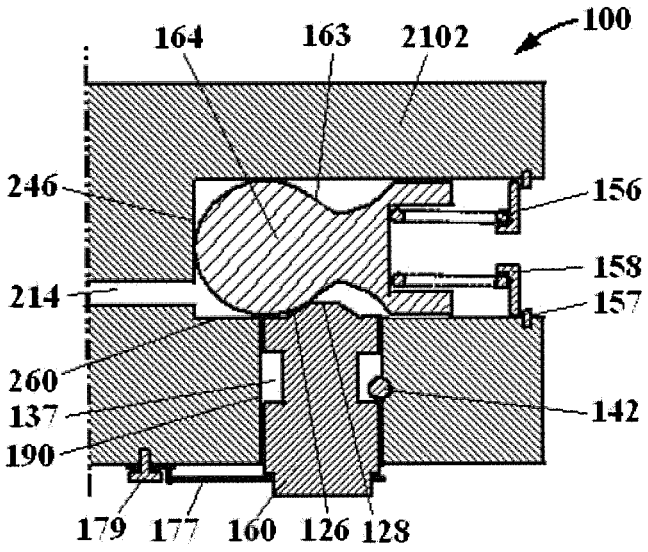
FIG. 10 is a schematic diagram of a fifth embodiment of the present application at the "off" position.
Figure 11:
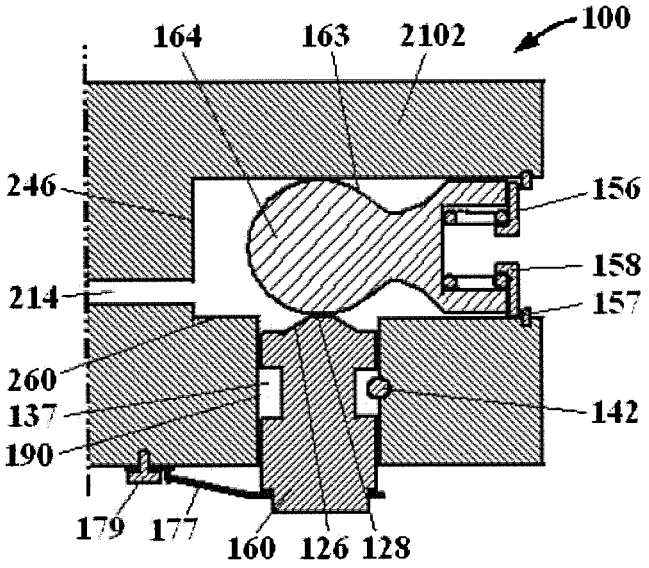
FIG. 11 is a schematic diagram of the fifth embodiment of the present application at the "on" position.

As shown in FIG. 10 and FIG. 11, the fifth embodiment is a variation of the third embodiment. The ball and the return piston are combined into one actuation piston. The right part of the actuation piston 164 functions as a guide and forms a liquid seal with the horizontal blind bore, while the left part is the actuation surface of a spherical shape (it may be of other shapes including a stepped surface, or an inclined surface, or a conical surface, or an arc surface, or a cylindrical surface, or a combination of two or more of the above-mentioned surfaces). The central part is a spherical surface 163 which may also be a conical surface. The operation principle of the present embodiment is similar to that of the third embodiment and detailed description thereof is omitted.

Sixth Embodiment

Figure 12:
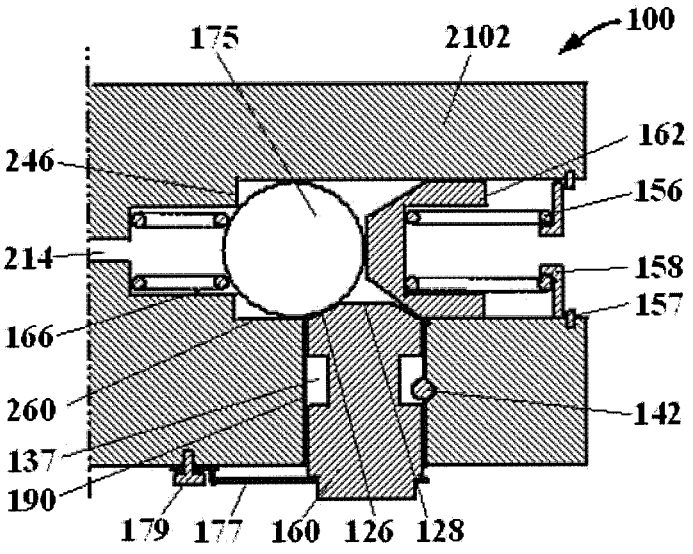
FIG. 12 is a schematic diagram of a sixth embodiment of the present application at the "off" position.
Figure 13:
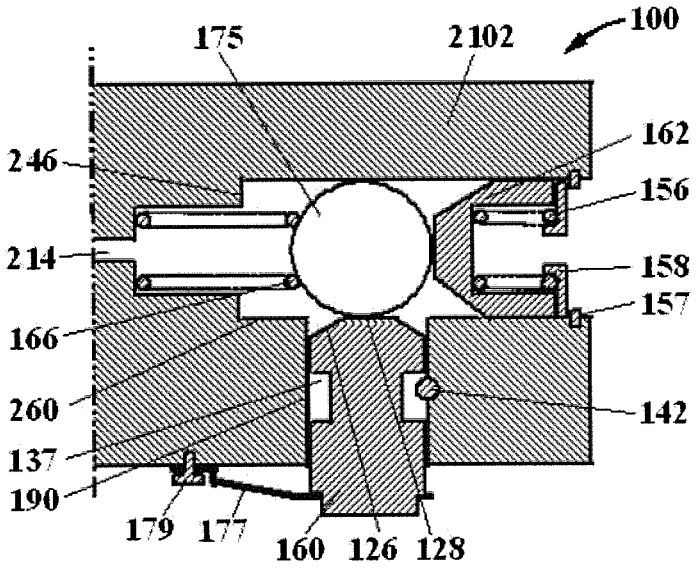
FIG. 13 is a schematic diagram of the sixth embodiment of the present application at the "on" position.

As shown in FIG. 12 and FIG. 13, compared with the third embodiment, the sixth embodiment is additionally provided with a return spring 166. One end of the return spring 166 is on the brake housing 2102, while the other end thereof is on the ball 175 of the actuation mechanism. The force of the return spring 166 is smaller than that of the return spring 156 such that when no oil pressure is applied, the ball 175 can be stopped against the shoulder 246 at the left end of the horizontal blind bore 260. At the same time, there is no decompression orifice or bleeding orifice (or a combined decompression and bleeding orifice) in the return piston 162. The operation principle of the present embodiment is similar to that of the third embodiment and detailed description thereof is omitted.

While the above description describes some embodiments, these embodiments should not be regarded as limitations to the scope of the present application, but are exemplifications of the preferred embodiments thereof. Many other variations are likely to be derived. For instance, the return spring and the brake spring herein may be of a cylindrical type, a leaf type, and a wave form, etc., and may also be installed or positioned at different places or orientations. In addition, the position limiter of the brake plunger may also be other forms. Accordingly, the scope of the present application should not be determined by the embodiments illustrated, but is determined by the claims and their legal equivalents.

What is claimed is:

1. A mechanical linkage engine brake device comprising:
a brake housing,
an actuation mechanism, and
a brake mechanism, wherein the brake housing includes an upright blind bore and a horizontal blind bore perpendicularly intersecting the upright blind bore; the actuation mechanism comprises one of a ball, an actuation piston and a ball-piston combination; the brake mechanism comprises a brake plunger; the one of the ball, the actuation piston and the ball-piston combination is disposed in the horizontal blind bore; the brake plunger is disposed in the upright blind bore; the brake housing includes a fluid passage in communication with an entrance of the horizontal blind bore; the brake plunger has an upper limit position and a lower limit position in the upright blind bore; in the upper limit position, a top of the brake plunger is in the horizontal blind bore; in the lower limit position, the one of the ball, the actuation piston and the ball-piston combination is in contact with the top of the brake plunger to push the brake plunger to the lower limit.

2. The mechanical linkage engine brake device of claim 1, wherein the actuation mechanism comprises a return spring, which has one end acting on the brake housing and the other end acting on the actuation piston or the ball-piston combination.

3. The mechanical linkage engine brake device of claim 1, further comprising a brake spring, the brake spring being provided between a lower end of the brake plunger and the brake housing.

4. The mechanical linkage engine brake device of claim 1, further comprising a position limiter between the brake plunger and the upright blind bore.

5. The mechanical linkage engine brake device of claim 1, wherein an upper end of the brake plunger includes a brake transition surface and a brake bearing surface, wherein each of the brake transition surface and the brake bearing surface comprises a stepped surface and an inclined surface, or a conical surface, or an arc surface, or a cylindrical surface, or a spherical surface, or a combination of two or more of the above-mentioned surfaces.

6. The mechanical linkage engine brake device of claim 1, wherein one end of the actuation piston includes a brake actuation surface, the brake actuation surface including an inclined surface, or a conical surface, or an arc surface, or a cylindrical surface, or a spherical surface, or a combination of two or more of the above-mentioned surfaces.

7. The mechanical linkage engine brake device of claim 1, wherein the brake housing comprises at least one of the following:
1) a dedicated bolt-on brake housing,
2) a dedicated brake rocker arm,
3) an engine exhaust rocker arm, and
4) an engine valve bridge.

8. The mechanical linkage engine brake device of claim 1, wherein in the lower limit position, the top of the brake plunger is outside of the horizontal blind bore.

9. A mechanical linkage engine brake device comprising:
a brake housing,
an actuation mechanism, and
a brake mechanism, wherein the brake housing includes an upright blind bore and a horizontal blind bore perpendicularly intersecting the upright blind bore; the actuation mechanism comprises a ball, or an actuation piston, or a ball-piston combination; the brake mechanism comprises a brake plunger; the ball, or the actuation piston, or the ball-piston combination is disposed in the horizontal blind bore; the brake plunger is disposed in the upright blind bore; the brake housing is provided with a fluid passage in communication with an entrance of the horizontal blind bore; an outer diameter of the ball or the actuation piston, or an outer diameter of the ball-piston combination matches an inner diameter of the horizontal blind bore; the brake plunger has an upper limit position and a lower limit position in the upright blind bore; in the upper limit position, a top of the brake plunger is in the horizontal blind bore; and in the lower limit position, the top of the brake plunger is outside of the horizontal blind bore, wherein the actuation mechanism comprises a return spring, which has one end acting on the brake housing and the other end acting on the actuation piston or the ball-piston combination, wherein the actuation mechanism comprises a return piston, the return piston being disposed in the horizontal blind bore and being pressed against the ball by the return spring.

10. The mechanical linkage engine brake device of claim 9, wherein the return piston has a decompression and bleeding orifice communicating with the horizontal blind bore and a space outside the brake housing.

11. A mechanical linkage engine brake device comprising:

a brake housing, an actuation mechanism, and a brake mechanism, wherein the brake housing includes an upright blind bore and a horizontal blind bore perpendicularly intersecting the upright blind bore; the actuation mechanism comprises a ball, or an actuation piston, or a ball-piston combination; the brake mechanism comprises a brake plunger; the ball, or the actuation piston, or the ball-piston combination is disposed in the horizontal blind bore; the brake plunger is disposed in the upright blind bore; the brake housing is provided with a fluid passage in communication with an entrance of the horizontal blind bore; an outer diameter of the ball or the actuation piston, or an outer diameter of the ball-piston combination matches an inner diameter of the horizontal blind bore; the brake plunger has an upper limit position and a lower limit position in the upright blind bore; in the upper limit position, a top of the brake plunger is in the horizontal blind bore; and in the lower limit position, the top of the brake plunger is outside of the horizontal blind bore, wherein the actuation mechanism comprises two return springs, the two return springs being placed in the horizontal blind bore and being arranged at opposite sides of the ball.

* * * * *